US007541542B2

(12) United States Patent
Park et al.

(10) Patent No.: US 7,541,542 B2
(45) Date of Patent: Jun. 2, 2009

(54) MICRO COAXIAL CABLE

(75) Inventors: Chan-Yong Park, Seoul (KR); Gi-Joon Nam, Seoul (KR); Jung-Won Park, Seoul (KR); In-Ha Kim, Seoul (KR); June-Sun Kim, Seoul (KR); Il-Gun Seo, Seoul (KR); Gun-Joo Lee, Seoul (KR)

(73) Assignee: LS Cable Ltd., Anyang (KR)

( * ) Notice: Subject to any disclaimer, the term of this patent is extended or adjusted under 35 U.S.C. 154(b) by 0 days.

(21) Appl. No.: 11/781,494

(22) Filed: Jul. 23, 2007

(65) Prior Publication Data

US 2008/0047732 A1 Feb. 28, 2008

(30) Foreign Application Priority Data

Jul. 21, 2006 (KR) ..... 10-2006-0068630

(51) Int. Cl.
*H01B 7/00* (2006.01)

(52) U.S. Cl. ..... 174/102 R; 174/106 R; 174/108

(58) Field of Classification Search ..... 174/28, 174/126.1, 126.2, 102 R, 106 R, 108
See application file for complete search history.

(56) References Cited

U.S. PATENT DOCUMENTS

| | | | | | |
|---|---|---|---|---|---|
| 4,970,112 | A * | 11/1990 | Hayami | ..... | 428/314.4 |
| 6,148,510 | A * | 11/2000 | Yokoi et al. | ..... | 29/828 |
| 6,477,767 | B1 * | 11/2002 | Zhao | ..... | 29/828 |
| 6,518,505 | B1 * | 2/2003 | Matsui et al. | ..... | 174/126.1 |
| 2003/0051897 | A1 * | 3/2003 | Blouin et al. | ..... | 174/106 R |
| 2007/0068696 | A1 * | 3/2007 | Matsui et al. | ..... | 174/113 R |

FOREIGN PATENT DOCUMENTS

| | | |
|---|---|---|
| JP | 2005-302412 | 10/2005 |

* cited by examiner

*Primary Examiner*—William H Mayo, III
(74) *Attorney, Agent, or Firm*—Jones Day

(57) ABSTRACT

A micro coaxial cable includes an inner conductor; an insulation layer having foaming cells and formed to surround the inner conductor; an over-foaming preventing layer formed to surround the insulation layer for the purpose of uniform forming of the foaming cells; a metal shield layer formed to surround the over-foaming preventing layer; and a protective coating layer formed to surround the metal shield layer.

7 Claims, 4 Drawing Sheets

Prior Art

MICRO COAXIAL CABLE

BACKGROUND OF THE INVENTION

1. Field of the Invention

The present invention relates to a micro coaxial cable, and more particularly to a micro coaxial cable in which foaming cells are formed uniformly in an insulation layer not to show any local difference of dielectric constant in the insulation layer, thereby giving excellent transmission characteristics.

2. Description of the Related Art

A coaxial cable includes a center conductor for transmitting signals, and an outer conductor coaxially formed on the center conductor, and many coaxial cables have been developed in various sizes and various kinds. The coaxial cable is generally used for transmitting signals to CATV or underground antennas. The development of coaxial cables has been mainly directed to a structural design between the center and outer conductors for reducing loss of energy, improvement of dielectric characteristics, and endowment of various schemes to an outside of the outer conductor.

In particular, along with the progress of high-technology information-oriented society, there is recently more demand for high-speed transmission rate of information communication devices and test/examination devices of semiconductor elements applied to the information communication devices.

A conventional coaxial cable includes an inner conductor 11, an outer conductor (or, a metal shield layer) 17, a polymer insulation layer (or, a dielectric layer) 13 formed between the inner conductor 11 and the outer conductor 17, and a protective coating layer 19 formed on the outer circumference of the outer conductor 17, as shown in FIG. 1. A transmission rate of the coaxial cable is determined by a dielectric constant of the insulation layer. That is, the transmission rate increases as the dielectric constant is lowered, and the dielectric constant is lowered as the degree of foaming of the insulation layer increases.

Thus, in the prior art, in order to get a high transmission rate and a low loss, a fluoric resin having a low dielectric constant is used for the insulation layer, a mixture ratio of general resin is controlled, or a supporter for supporting a gap between the center conductor and the outer conductor is used such that an air layer having a lowest dielectric constant surrounds the center conductor. In particular, the recent study is mainly focused on the technique for lowering a dielectric constant by foaming polymer material.

Meanwhile, portable multimedia devices and medical instruments such as an endoscope are recently extremely small-sized, so a micro coaxial cable having a diameter of 1 mm or less for driving the above devices is under development. The micro coaxial cable includes an inner conductor, an insulation layer, an outer conductor and a protective coating layer, which is basically similar to the traditional coaxial cable. The micro coaxial cable uses a high frequency in GHz range on occasions, and in this case 'Skin Effect' occurs due to the high frequency transmission, so a dielectric constant of a polymer insulation layer surrounding the micro coaxial cable is an important factor in the transmission characteristics of the micro coaxial cable. Meanwhile, in the polymer insulation layer in which a region having a foaming cell is crossed with a region having no foaming cell, the dielectric constant may vary locally due to the 'Skin Effect', which may cause a fatal ill effect to the transmission characteristics. Accordingly, 'uniformity of foaming' in the polymer insulation layer becomes a very important factor. Conventional general or large-sized coaxial cables have a common diameter of 5 to 42 mm so an insulation layer has a sufficient thickness, thereby keeping a uniform outer diameter during the foaming process and also capable of realizing uniform foaming sizes. However, the micro coaxial cable has a whole diameter of 1 mm or less, so foams may grow abnormally or an outer diameter becomes unbalanced. In particularly, since an insulation layer has a thickness of merely about 0.05 mm, irregularity of the insulating thickness causes local differences of dielectric constants, thereby resulting in deterioration of transmission characteristics. There are persistently many endeavors for solving such disadvantages in the relevant fields, and the present invention is designed under this circumstance.

SUMMARY OF THE INVENTION

Therefore it is an object of the present invention to provide a micro coaxial cable, in which foaming cells are uniformly formed such that a dielectric constant in an insulation layer is uniform, not showing any local difference, thereby giving excellent transmission characteristics.

In order to accomplish the above object, the present invention provides a micro coaxial cable, which includes an inner conductor; an insulation layer having foaming cells and formed to surround the inner conductor; an over-foaming preventing layer formed to surround the insulation layer for the purpose of uniform forming of the foaming cells; a metal shield layer formed to surround the over-foaming preventing layer; and a protective coating layer formed to surround the metal shield layer.

The micro coaxial cable may be more effectively used when it is made with a diameter of 1 mm or less. The insulation layer preferably has a thickness of 0.03 to 0.09 mm, more preferably 0.035 mm to 0.075 mm. The foaming cells provided in the insulation layer preferably have a size of 0.02 to 0.07 mm, and the over-foaming preventing layer preferably has a thickness of 0.01 to 0.04 mm. The over-foaming preventing layer has a lower melt temperature than the insulation layer. The insulation layer is preferably made of fluoric resin, among which PFA (PerFluoroAlkoxy) is most preferred. The over-foaming preventing layer is preferably made of one or more polymer resin selected from the group consisting of polyethylene, polypropylene and polyethylene terephthalate. The insulation layer and the over-foaming preventing layer are preferably formed using co-extrusion or tandem extrusion.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings for better understanding of the present invention. However, the embodiments of the present invention may be modified in various ways, and the present invention should not be interpreted as being limited to the following embodiments. The embodiments of the present invention are provided just for better understanding of the present invention to those having ordinary skill in the art.

A micro coaxial cable according to the present invention includes an over-foaming preventing layer formed to surround an insulation layer, so foaming cells formed in the insulation layer are successively adjacently formed with a uniform size. Due to the uniformity of foaming, a dielectric constant in the insulation layer is uniform as a whole without showing any local difference, thereby giving excellent transmission characteristics.

The micro coaxial cable according to the present invention has no special limitation in its diameter. However, since a micro coaxial cable having a diameter of 1 mm or less shows serious problems such as abnormal growth of foams or unbalance of an outer diameter while forming foaming cells in an insulation layer, the present invention may be more effectively applied to a micro coaxial cable having a diameter of 1 mm or less.

Figure 1:
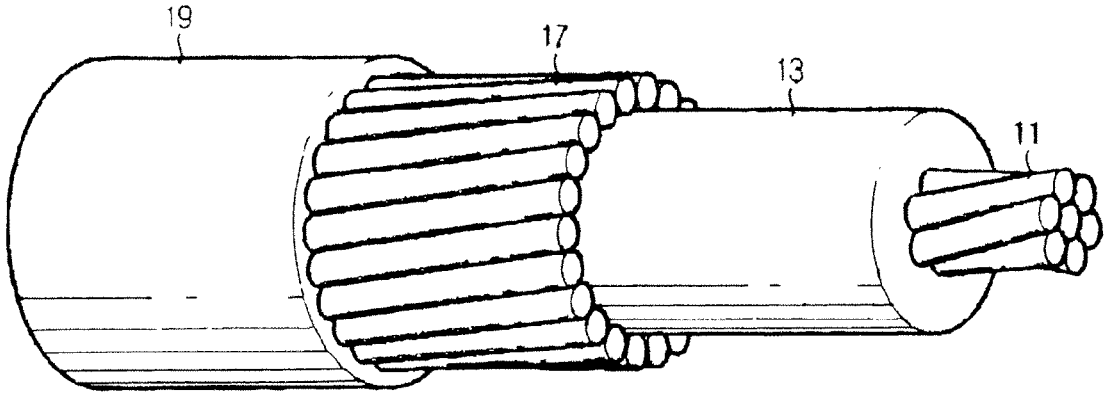
FIG. 1 is a perspective view schematically showing a conventional coaxial cable.
Figure 2:
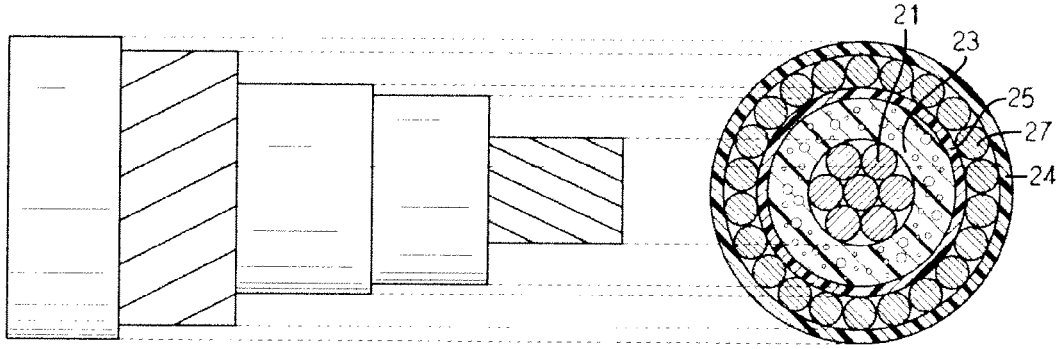
FIG. 2 is a side and sectional view showing a micro coaxial cable according to one embodiment of the present invention.

FIG. 2 is a sectional and side view showing a micro coaxial cable according to one embodiment of the present invention.

Referring to FIG. 2, the micro coaxial cable of this embodiment includes an inner conductor 21, an insulation layer 23 formed to surround the inner conductor 21, an over-foaming preventing layer 25 formed to surround the insulation layer 23 in contact with the insulation layer 23, a metal shield layer 27 formed to surround the over-foaming preventing layer 25 in contact with the over-foaming preventing layer 25, and a protective coating layer 24 formed to surround the metal shield layer 27 in contact with the metal shield layer 27.

The inner conductor 21 is composed of one or several conductive wires, and preferably several conductive wires are twisted or stranded at a predetermined pitch to make the inner conductor 21. The conductive wires are preferably made of copper alloy in consideration of electric conductivity and economy. The inner conductor preferably has a diameter of 0.04 to 0.09 mm in consideration of the entire diameter of the micro coaxial cable, and each conductive wire preferably has a diameter of 0.01 to 0.04 mm when several conductive wires are twisted to make the inner conductor.

Polymer having a low dielectric constant is extruded and coated on the outer circumference of the inner conductor to form the insulation layer 23 in order to improve transmission characteristics. In order to lower the dielectric constant, fluoric resins are preferred, among which PFA (PerFluoro-Alkoxy) is most referred. In addition, in order to further lower the dielectric constant, polymer is foamed such that foaming cells are formed in the insulation layer 23. For this purpose, a gas injection device, a mixing screw and a nozzle are applied to the extruder, and a foaming cell is formed at an outlet of the extruder. When being employed in the micro coaxial cable, the insulation layer preferably has a thickness of 0.03 to 0.09 mm in consideration of electric features, more preferably 0.035 to 0.075 mm. If the insulation layer has a thickness less than 0.03 mm, it is not easy to meet the characteristic impedance having suitable power transmission characteristics. If the insulation layer has a thickness exceeding 0.09 mm, it can be hardly used for a micro coaxial cable. In the present invention, foaming cells formed in the insulation layer are adjacent to each other, differently from the conventional ones, and thus it is possible to give a uniform dielectric constant. The foaming cell preferably has a size of 0.02 to 0.07 mm. A foaming cell having a size less than 0.02 mm can be hardly realized, and a foaming cell having a size exceeding 0.07 mm is restricted due to the thickness of the insulation layer.

The over-foaming preventing layer 25 is formed to surround the insulation layer 23 in contact with the insulation layer 23, and it prevents over-foaming when foaming cells are formed in the insulation layer 23. Thus, the over-foaming preventing layer 25 allows foaming cells to be uniformly formed in the insulation layer, attributes to restraining of formation of abnormal foaming cell, and makes foaming cells be adjacent to each other. The over-foaming preventing layer 25 as mentioned above preferably has a lower melt temperature than the insulation layer 23, in order to induce uniform growth of cells by facilitating cooling of the foams of the insulation layer 23. Thus, the over-foaming preventing layer 25 is preferably made of polyethylene (PE), polypropylene (PP), polyethylene terephthalate (PET), or their mixtures, among which PET having the fastest cooling speed is most preferred. In particular, PET has a processing temperature of about 200° C., similar to fluoric resins, so it is advantageous in aspect of thermal stability in comparison to polyethylene or polypropylene that has a processing temperature of about 100° C. The over-foaming preventing layer preferably has a smaller thickness than the insulation layer, preferably in the range of 0.01 to 0.04 mm.

When the insulation layer 23 and the over-foaming preventing layer 25 are formed, an extruder nozzle conducts co-extrusion or successive double extrusion (or, tandem extrusion) such that the over-foaming preventing layer 25 directly covers the outer circumference of the foamed insulation layer 23. In this way, at the same time as the insulation layer 23 is extruded, the over-foaming preventing layer 25 is extruded on the outer circumference of the insulation layer. The over-foaming preventing layer 25 is instantly cooled after passing through the nozzle in a melt state, and restrains excessive foam growth when gas is foamed in the insulation layer 23, thereby facilitating to make uniform and fine foams. In addition to the above effects, it is possible to improve productivity since a separate cooling line is not required by applying the co-extrusion or tandem extrusion.

Figure 3:
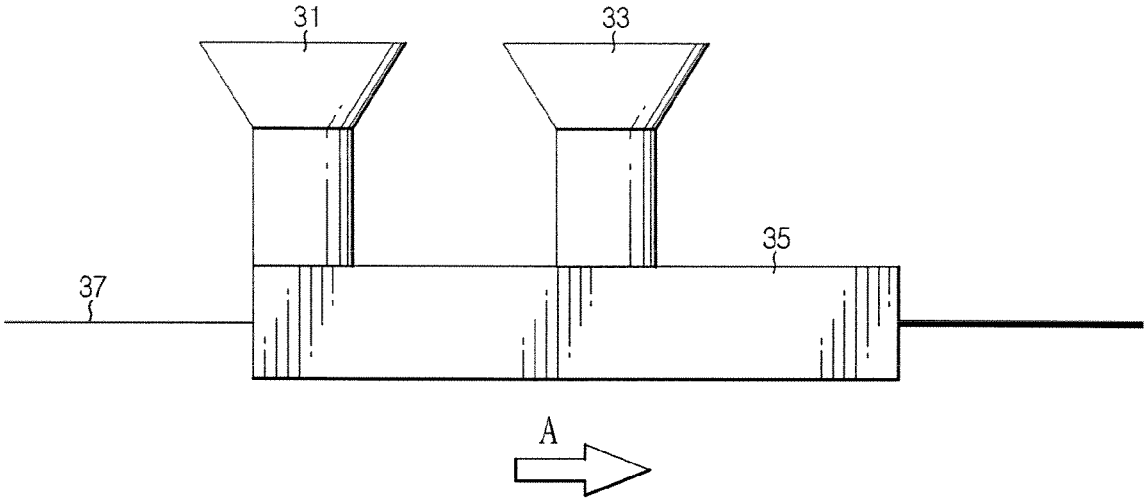
FIG. 3 is a schematic view showing a co-extruder used for making the micro coaxial cable according to the present invention.

FIG. 3 is a schematic view showing an extruder for conducting co-extrusion (namely, a co-extruder), which is used for making the micro coaxial cable according to the present invention. Referring to FIG. 3, the co-extruder includes an insulation layer resin supplier 31 for supplying resin used for forming an insulation layer, a preventing layer resin supplier 33 for supplying resin used for forming an over-foaming preventing layer, and a head 35. As a conductive wire 37 progresses in a wire advancing direction A, the insulation layer 23 is extruded on the outer circumference of the conductive wire, and at the same time the over-foaming preventing layer 25 is extruded on the outer circumference of the insulation layer.

The metal shield layer 27 made of metal mesh, metal filament, helical winding or metal thin film is formed on the outer circumference of the over-foaming preventing layer 25, and the protective coating layer 24 is formed on the outer circumference of the metal shield layer 27 so as to protect the micro coaxial cable. The protect coating layer 24 may be made of any material used for forming the protective coating layer 24 of a conventional coaxial cable, without any limitation.

The micro coaxial cable configured as mentioned above, which includes the over-foaming preventing layer 25 on the outer circumference of the insulation layer 23, allows to form foaming cells with uniform size on the insulation layer 23 and restrain any local difference of dielectric constant caused by broken foams or partially clumping foams, thereby capable of preventing signal deterioration according to a high frequency transmission.

Figure 4:
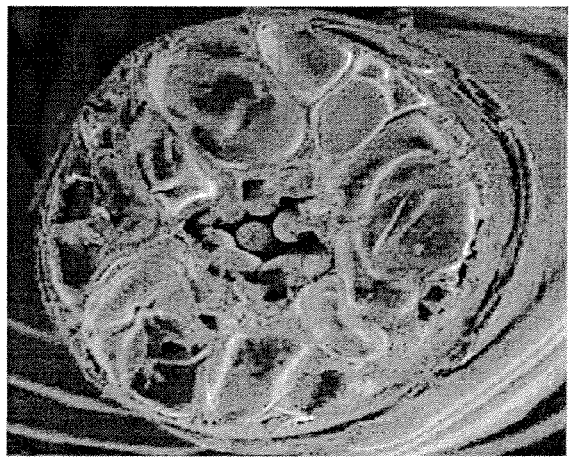
FIG. 4 is a photograph showing foaming cells in an insulation layer of the micro coaxial cable according to the present invention.
Figure 5:
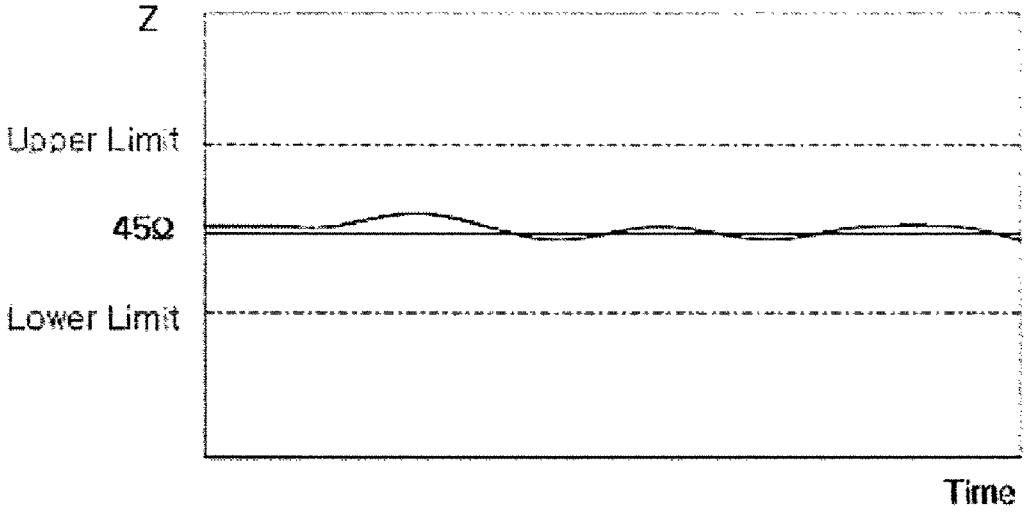
FIG. 5 is a graph showing a measurement result of a characteristic impedance (Z) of a micro coaxial cable according to the present invention, measured by an impedance analyzer.

FIG. 4 is a photograph showing foaming cells of the insulation layer 23 of the micro coaxial cable according to the present invention, and FIG. 5 is a graph showing a measurement result of a characteristic impedance (Z) of the micro coaxial cable according to the present invention, measured by an impedance analyzer. Seeding FIG. 4, it would be understood that foaming cells are formed successively with uniform size. Also, from FIG. 5, it would be understood that the characteristic impedance is substantially kept uniformly between the upper and lower limits.

Figure 6:
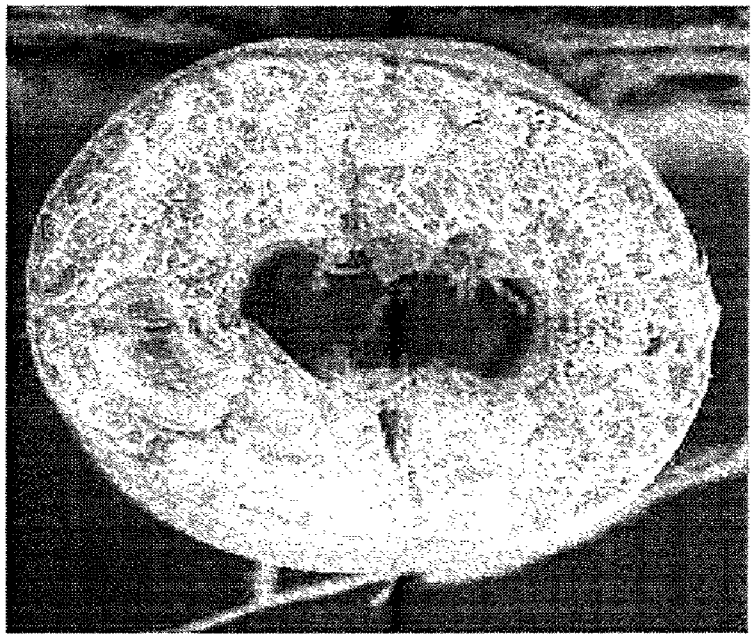
FIG. 6 is a photograph showing foaming cells of a conventional micro coaxial cable.
Figure 7:
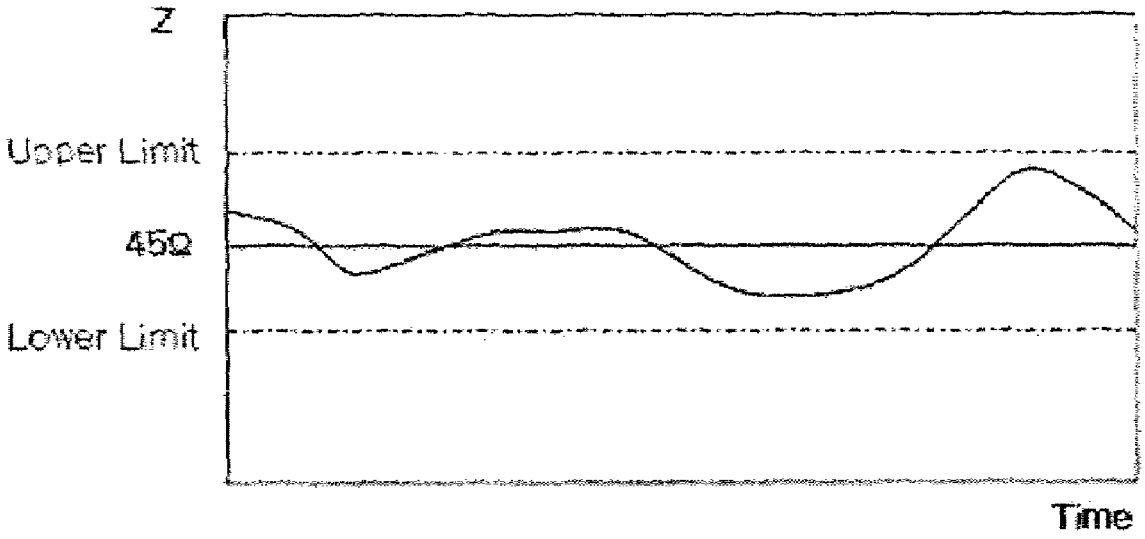
FIG. 7 is a graph showing a measurement result of a characteristic impedance of a conventional micro coaxial analyzer, measured by an impedance analyzer.

FIG. 6 is a photograph showing foaming cells in a conventional micro coaxial cable, namely a coaxial cable having no over-foaming preventing layer, and FIG. 7 is a graph showing a measurement result of a characteristic impedance of a conventional micro coaxial cable, measured by an impedance analyzer. Seeing FIG. 6, it would be understood that foaming cells have irregular sizes and are not formed adjacently but formed sparsely. Seeing FIG. 7, it would be understood that a dielectric constant locally varies due to irregular sizes of the foams in length and radial directions, and thus a characteristic impedance varies in a length direction, approximating to the upper and lower limits of the standard in a severe region, so its characteristic is unstable.

APPLICABILITY TO THE INDUSTRY

The micro coaxial cable according to the present invention includes the over-foaming preventing layer formed to surround the insulation layer, thereby restraining abnormal growth of foaming cells formed in the insulation layer such that the foaming cells are successively adjacently formed with uniform size. Thus, due to the uniformity of foaming, the dielectric constant of the insulation layer is not locally different but uniform as a whole, thereby capable of improving transmission characteristics.

In addition, the micro coaxial cable of the present invention enables to transmit signals even at a high frequency transmission of GHz range, which was impossible in the prior art. Also, the micro coaxial cable of the present invention ensures excellent transmission characteristics due to the uniformity of dielectric constant in the insulation layer even when it is made into a very small size with a diameter of 1 mm or less, furthermore in an ultra small size of so far as 0.21 mm or less. Thus, the micro coaxial cable of the present invention may be made into a very small size, and it may also allow medical instruments such as an endoscope to have a very small size, which may relieve the pain of a patient during medical examination and treatment.

What is claimed is:

1. A micro coaxial cable, comprising:

an inner conductor;

an insulation layer having foaming cells and formed to surround the inner conductor;

an over-foaming preventing layer formed to surround the insulation layer for the purpose of uniform forming of the foaming cells;

a metal shield layer formed to surround the over-foaming preventing layer; and a protective coating layer formed to surround the metal shield layer, wherein the over-foaming preventing layer has a lower melt temperature than the insulation layer, wherein the over-foaming preventing layer is made of one or more polymer resins selected from the group consisting of polyethylene, polypropylene and polyethylene terephthalate, wherein the insulation layer and the over-foaming preventing layer are formed using co-extrusion or tandem extrusion, and wherein the micro coaxial cable has a diameter of 1 mm or less.

2. The micro coaxial cable according to claim 1, wherein the insulation layer has a thickness of 0.03 to 0.09 mm.

3. The micro coaxial cable according to claim 1, wherein the foaming cells provided in the insulation layer have a size of 0.02 to 0.07 mm.

4. The micro coaxial cable according to claim 1, wherein the over-foaming preventing layer has a thickness of 0.01 to 0.04 mm.

5. The micro coaxial cable according to claim 1, wherein the over-foaming preventing layer has a smaller thickness than the insulation layer.

6. The micro coaxial cable according to claim 1, wherein the insulation layer is made of fluoric resin.

7. The micro coaxial cable according to claim 6, wherein the fluoric resin is PFA (PerFluoroAlkoxy).

* * * * *